US005896583A

United States Patent [19]

Grilliot et al.

[11] Patent Number: 5,896,583

[45] **Date of Patent: *Apr. 27, 1999**

[54] PROTECTIVE GARMENT FEATURING AN INSULATIVE AND FLUID DISPERSIVE PAD

[75] Inventors: William L. Grilliot; Mary I. Grilliot, both of Dayton, Ohio

[73] Assignee: Morning Pride Manufacturing, L.L.C., Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/567,095

[22] Filed: Dec. 4, 1995

Related U.S. Application Data

[63] Continuation of application No. 08/156,354, Nov. 22, 1993, abandoned, which is a continuation of application No. 07/884,665, May 18, 1992.

[51] Int. Cl.[6] ..... A41D 13/00

[52] U.S. Cl. ..... 2/81; 2/23; 2/24; 2/82; 2/458

[58] Field of Search ..... 2/24, 81, 82, 87, 2/267, 457, 458, DIG. 5, 62, 23, 455

[56] References Cited

U.S. PATENT DOCUMENTS

| | | | |
|---|---|---|---|
| 2,994,089 | 8/1961 | Ferguson, Jr. et al. | 2/81 |
| 4,422,183 | 12/1983 | Landi et al. | 2/455 |
| 4,502,153 | 3/1985 | Lapedes et al. . | |
| 4,688,269 | 8/1987 | Maeshima | 2/24 |
| 4,831,666 | 5/1989 | Denman . | |
| 5,150,476 | 9/1992 | Statham et al. . | |
| 5,219,367 | 6/1993 | Fields . | |
| 5,267,354 | 12/1993 | Grilliot et al. . | |
| 5,539,928 | 7/1996 | Aldridge . | |
| 5,697,101 | 12/1997 | Aldridge . | |
| 5,701,606 | 12/1997 | Aldridge . | |
| 5,720,045 | 2/1998 | Aldridge . | |
| 5,724,673 | 3/1998 | Aldridge . | |
| 5,729,832 | 3/1998 | Grilliot et al. . | |

*Primary Examiner*—Diana L. Biefeld
*Attorney, Agent, or Firm*—Rockey, Milnamow & Katz, Ltd.

[57] ABSTRACT

The present invention relates to a protective pad which may be used in a protective garment such as firefighter's garment. The pad of the present invention is designed to provide both insulation to the area covered by the pad, and dispersal of heated vapors and/or liquids away from this area. The pad of the present invention comprises an insulating construction that features a plurality of channels which allow the pad to accept and disperse heated vapors and/or liquids. The present invention also includes a firefighter's garment containing such a protective pad.

16 Claims, 2 Drawing Sheets

PROTECTIVE GARMENT FEATURING AN INSULATIVE AND FLUID DISPERSIVE PAD

This is a continuation of copending application Ser. No. 08/156,354 filed on Nov. 22, 1993, now abandoned, which is a continuation of Ser. No. 07.884,665, filed on May 18, 1992, now abandoned.

TECHNICAL FIELD

The present invention relates to a protective pad which may be used in a protective garment such as firefighter's garment. The pad of the present invention is designed to provide both insulation to the area covered by the pad, and dispersal of heated vapors and/or liquids away from this area. The pad of the present invention comprises an insulating construction that features a plurality of channels which allow the pad to accept and disperse heated vapors and/or liquids. The present invention also includes a firefighter's garment containing such a protective pad.

BACKGROUND OF THE INVENTION

During the fighting of a fire, a firefighter works in a very hostile environment. Many firefighters lose their lives while fighting fires. Most of the deaths of firefighters while fighting fires are a result of stress, heart attacks, strokes, and the like. Of course, a firefighter must be protected from the environment within which the firefighter works.

Beyond the dangers to the firefighter's life, firefighter's are also exposed to great danger of severe burns. Their bodies are exposed to burning, smoldering or other heated surfaces or surfaces from which steam or other hot vapors emanate. This normally occurs either where firefighter's are brought into contact with such surfaces in supporting themselves on such a surface, or in moving through a burning, smoldering or heated structure. This most often has effect on the joint areas and other areas which are compressed by localized pressure, and/or dampened by heated vapors or liquids. Localized pressure can occur in these areas for instance where a firefighter kneels or crawls, leans on his or her elbows, or brings his or her shoulders into contact with a burning, smoldering or heated surface, especially those from which liquids and/or vapors emanate.

Hot liquids and vapors are particularly dangerous due to their high heat capacity and their ability to penetrate a firefighter's garment, especially where the garment is compressed by localized pressure, causing rapid and serious burning.

Localized pressure may also occur in a firefighter's garment as the firefighter moves and works. During firefighting activity, a firefighter frequently finds it necessary to carry relatively heavy and/or bulky items, such as breathing apparatus, tanks, water hose and the like; and even fire victims. Such heavy items carried by the firefighter serve to apply increased pressure upon portions of the firefighter's clothing. Compression of the firefighter's garment in these areas renders corresponding areas of the firefighter's garment more permeable to hot vapors or liquids and thus more vulnerable to burns.

Burn injury (i.e., first degree burn) occurs when skin temperatures rise above 115° F. regardless of exposure time. Second degree burns or blistering occurs when skin temperatures reach about 132° F. Burn injury is a function of temperature and exposure time and the rate of injury increases logarithmically with the increase in temperature. Also, total burn damage is the sum of that resulting from the heating and cooling back to a safe skin temperature level.

Very little research has been accomplished to study the effects of conduction of heat through compressed, wet fabrics. Most studies have investigated the radiative-convective thermal loads typically encountered during structural firefighting. These studies pertain to pain or burn injury on contact with metals, plastics or glass (e.g., Stoll, et al. 1979, Veghte 1974). The physical environment firefighter's contend with is one which features potentially dangerous temperature extremes. As a result, firefighting is an extremely hazardous profession.

Air temperature and thermal radiation correspond for routine, ordinary or emergency firefighting situations. Under emergency conditions encountered inside a flashover room, the function of firefighter's clothing is simply to provide 15 to 30 seconds of protection to allow escape.

One way in which heat is transferred is by conduction. Heat loss or gain by conduction normally concerns only that part of one surface which is in direct contact with another surface. Heat flows through the resulting continuity of surface. The roll of heat conduction in bunker gear is usually underestimated. It is significantly increased to protective clothing as wet or compressed. Water can provide a conductive bond between surfaces that might not otherwise touch, and can increase the heat conduction by displacing insulating air between and within the layers of clothing. Even without water, compression brings surfaces closer together, thus permitting more conduction of heat and providing less potentially insulative air between clothing layers.

Recent NFPA standards (1500 and 1971) require full torso bunker clothing protection for structural firefighter's (both coat and pants, as opposed to the coat alone with high boots worn in the past). This is required due to the tremendously high levels of protection the full torso system offers when unexpected though inevitable exposure occurs. However, there are still some disadvantages associated with this system. For instance, while the full torso system protects the firefighter much more effectively by insulating him or her from the fire, this insulation may cause the firefighter not to feel discomfort as early otherwise he or she might. Since the perception of discomfort is an indicator to the firefighter that he could be vulnerable, this remains a disadvantage. The firefighter may absorb a lot of heat energy into a system before sensing that he or she is in danger. However, experienced firefighter's eventually learn to gauge a particular situation by the degree of discomfort they feel. Nonetheless, the change in insulation can cause the firefighter not to sense the thermal loading problems he may encounter. These problems become more severe when the firefighter's garment is wet (such as through sweating or exposure to water). Once a firefighter's garment becomes wet, the warning time (i.e., the time between pain recognition and the onset of second degree burn blistering) decreases substantially. Also, when the firefighter's garment system is wet, the decreased insulative performance is exasperated by the fact that water held in the garment system, when exposed to sufficient heat, turns into steam, expanding in volume and carrying tremendous amounts of heat and energy into the most permeable parts of the garment.

For instance, when a firefighter is kneeling on a substantially impermeable surface compressing the garment system tightly against the skin at the knee, this area can present a target for hot vapors or gases which can permeate into the garment. Blistering on the knees commonly occurs when firefighter's are crawling on hot surfaces. Because of this, most firefighter's use a so called "duck walk" when hot floors are encountered. Leather knee pads have been used in the past to provide more thermal insulation and abrasion protection in this area. However, these pad did not provide means for dispersing hot fluids from the pad area. The degree of wetness, the degree of thermal loading and constriction of the garment all contribute to the extent of steam generation, and correspondingly, the extent resulting burns. Firefighter's knee burns have occurred quite often as a result. The same problem exists (although not quite as frequently) at other stressed, pinned or compressed body areas such as shoulders, elbows, shins, forearms, etc.

Present firefighter garment designs have not provided for improved protection from hot vapors and liquids. Firefighter's coats and trousers customarily have three layers of material: an outer shell or layer, which is flame resistant and abrasion resistant, an intermediate layer which is a moisture barrier, and an inner layer, which is a thermal barrier. These layers may be three separate distinct layers or may be one or two members.

Recently, firefighter's garments have been described which feature so-called "dead air" spaces are described in U.S. Pat. Nos. 4,897,886 and 5,001,783, both to Grilliot et al; and both of which are hereby incorporated herein by reference.

Accordingly, it an object of the present invention to provide a protective garment which has the same quality of protection or better protection against the environment than conventional protective garments, but which further protect the firefighter from the dangers of hot liquids or vapors. It should be understood that while some of the advantages of the protective garment of the present invention are described in terms of a firefighter's garment, the protective garment of the present invention is not limited to use in firefighting. Rather, it may be used for protection against similarly hostile environments.

SUMMARY OF THE INVENTION

Toward accomplishing the objectives outlined above, the present invention in its broadest form comprises a pad for protecting an area of a protective garment, said pad forming a plurality of channels adapted to accept and disperse a fluid from the area covered by the pad to the outside of the garment. As used herein, the term "pad" shall be understood as including a portion for a protective garment which my be integrated into said garment or may be attached separately to the outside of said garment.

One of the main purposes of the pad of the present invention is to channel heated fluids, such as hot vapors (e.g., steam) and liquids so that these fluids may be dispersed within and/or channeled from the area protected by the pad. As used herein, it shall be understood that the term "channels" may refer, without limitation, to the regular fluid pathways through a mesh-type material or to more well defined channels, such as grooves or tubular channels formed by material constructions exemplified in the accompanying drawings. These channels may be formed wholly within the pad or, preferably, they may be formed as channels directly opened to the outside of the protective garment. Thus, the basic concept of the invention is to provide a protective garment with channeling means to be able to direct hot fluids from the area covered by the pad even when the pad is pressed against a surface emitting hot fluids.

Another benefit of the some embodiments of the present invention is that the air spaces maintained in the pad serve to insulate the pad area of the protective garment.

The arrangement of parts forming the pad of the present invention may be one of any number of geometric, integral or non-integral arrangement of parts while still being able to perform the function of the present invention.

In addition to being flame resistant, the material from which the pad is made may also have insulative qualities as desired depending upon the existing qualities of the protective garment to which the pad is to be applied.

As is exemplified more fully herein, it will be appreciated that the spacer means or material may be formed in a variety of ways.

The pad of the present invention may also be formed with channels opened directly to the outside of the protective garment. In such an arrangement, the pad comprises a plurality of spacer members disposed on the outer shell of the garment so as to form a plurality of channels adapted to accept and disperse a fluid. Such a pad may be made by any geometric arrangement of spacer members provided the channels access the edges of the pad. It is preferred that the spacer members be disposed on a base member (especially when the outer shell material is permeable to hot fluids) and that both the spacer members and the base member be made of a heat resistant, flame resistant and/or abrasion resistant material. The base member and spacer members may be made of one or more pieces, or may be integrated into a single piece. It is also preferred that the spacer members be made of a material which is sufficiently flexible to allow comfortable movement within the protective garment upon which the pad is placed. It is also preferred that the spacer members have sufficient dimensional stability to resist compression which could diminish the size of the channels formed thereby.

The present invention also includes a protective garment containing one or more pads of the present invention as described herein. The pad of the present invention may be placed anywhere on the protective garment such as preferably on or at the knees, elbows, shoulders, shins, forearms, etc.

DESCRIPTION OF THE DRAWINGS

FIG. 4 may be considered as being substantially along line 2—2 FIG. 1.

FIG. 6 may be considered as being taken substantially along a line to 2—2 of FIG. 1.

DETAILED DESCRIPTION OF THE PREFERRED EMBODIMENTS

The following is a description of several preferred embodiments of the present invention.

Figure 1:
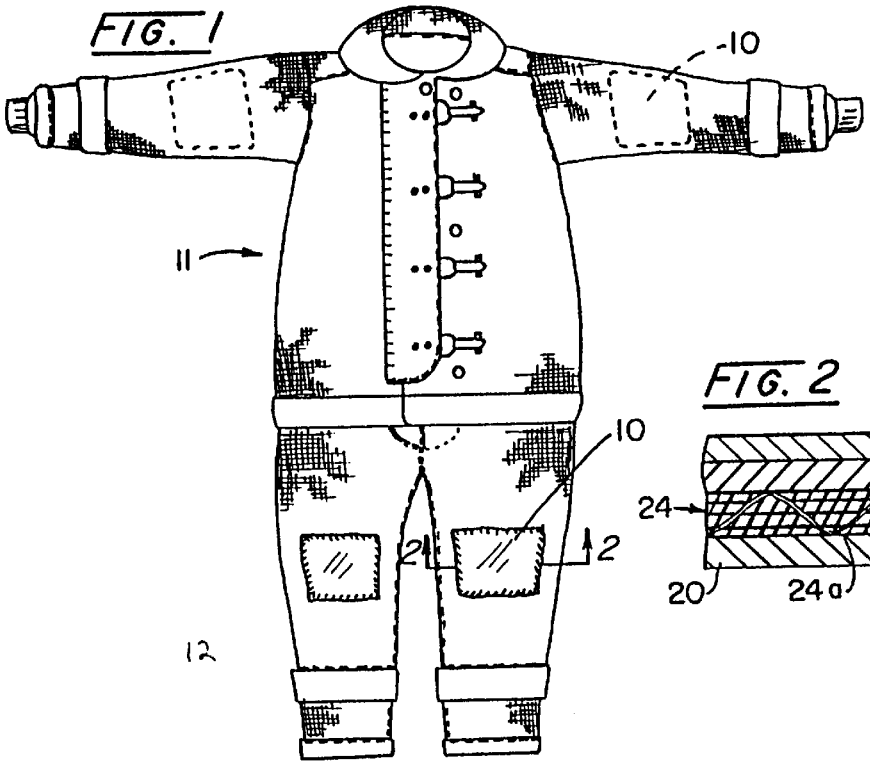
FIG. 1 is a plan view showing a protective garment comprising a coat and trousers, and showing pad of the present invention placed at the knee and elbow areas.

FIG. 1 shows a protective coat or jacket 11 and trousers 12 upon which a pad according to the present invention may be used. The coat 11 and the trousers 12 may comprise one or more layers of material. Preferably, the coat 11 has an outer shell or outer layer which is flame resistant and abrasion resistant material. The coat may also have an intermediate layer where there is a moisture barrier; and an inner layer which is a thermal barrier.

FIG. 1 also shows example positions of pads 10, here shown placed at the knee and elbow areas.

Figure 2:
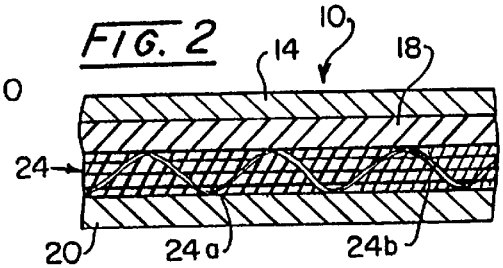
FIG. 2 is a greatly enlarged sectional view of the pad (alone) in accordance with one embodiment of the present invention, taken along a line 2—2 of FIG. 1.

FIG. 2 shows an embodiment of the present invention which involves creating channels in a pad in accordance with one embodiment of the present invention. FIG. 2 shows pad 10 which is comprised by outer cover layer 14 which is of a flame resistant material. Intermediate layer 18 is an optional moisture barrier material and base layer 20 is a thermal barrier material. The spacer member 24 is shown as including a corrugated element 24*a* and a plurality of flat elements 24*b*. The elements 24*a* and 24*b* are attached together. The spacer member 24 is attached to the base layer 20 and/or to the optional intermediate layer 18 by any suitable means, such as stitching, use of adhesive, or the like. The spacer member 24 may be any suitable heat resistant material. The spacer member may be, for example, a Teflon (a registered trademark of E. I. du Pont de Nemours and Company) material or the like. The spacer member 24 may also be, for example, constructed of a material sold by Kimbre, Inc. of Perrino, Fla., and referred to by that company as mist eliminator material. The pad shown in FIG. 2 is placed atop the other shell (not shown in FIG. 2) of the protective garment. If the outer shell of the garment is sufficiently impervious to hot fluids, the base layer 20 may be eliminated.

Figure 3:
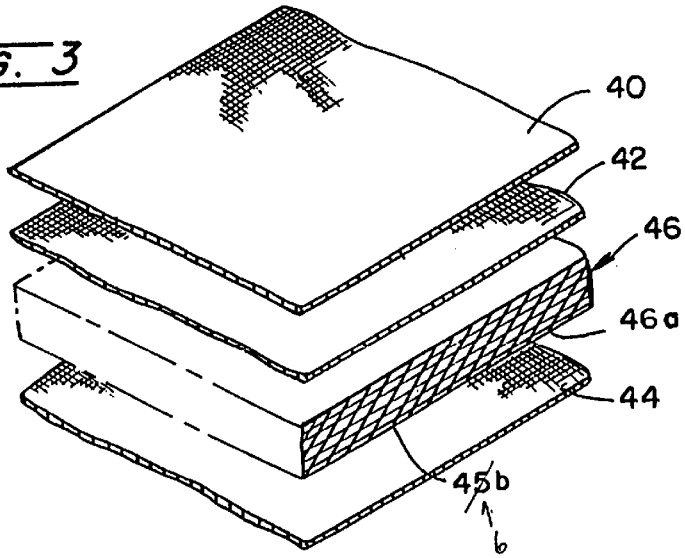
FIG. 3 is an exploded sectioned perspective view, drawn on a somewhat smaller scale than FIG. 2, illustrating a modification in the spacer means which is positioned between the inner layer and the intermediate layer of a pad in accordance with one embodiment of the present invention.

FIG. 3 shows a portion of another pad made in accordance with the present invention. This pad includes a cover layer 40, optional intermediate layer 42 and an inner layer 44. Between the inner layer 44 and the intermediate layer 42 is a spacer member 46, which is shown as being a sheet or liner having a plurality of interwoven corrugated spacer elements 46*a* and a plurality of flat spacer elements 46*b*. The spacer elements for 46*a* and 46*b* are attached together and provide a fluid channel or fluid channels between the intermediate layer 42 and the base layer 44. These spacer elements 46*a* and 46*b* may be of Teflon material or any other heat resistant material. The spacer member 46 is attached to the intermediate layer 42 and to the inner layer 44 by any suitable means, such as by stitching, use of adhesive, or the like. Thus the spacer members 46 provide fluid channels within the pad and thus provide thermal insulation and the ability to disperse fluids entering the pad. A pad of this type is placed atop the outer layer of a protective garment. If the outer shell of the garment is sufficiently impervious to hot fluids, the base layer 44 may be eliminated.

Figure 4:
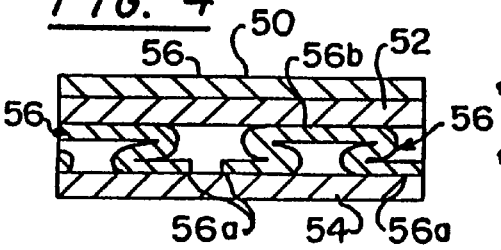
FIG. 4 is fragmentary sectional view, drawn on substantially the same scale as FIG. 2 illustrating another modification in the spacer means positioned between the inner layer and the intermediate layer in a pad constructed in accordance with one embodiment of the present invention.
Figure 5:
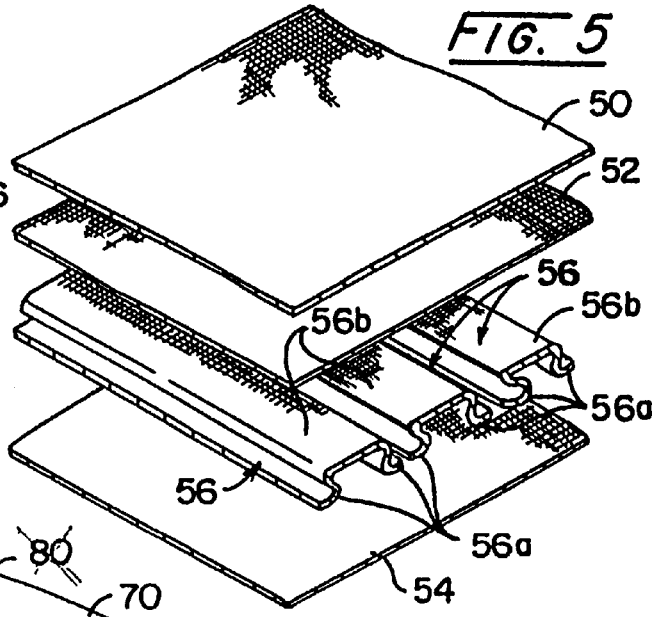
FIG. 5 is an exploded fragmentary prospective view, drawn on substantially the same scale as FIG. 3, further illustrating the spacer structure shown in FIG. 4.
Figure 7:
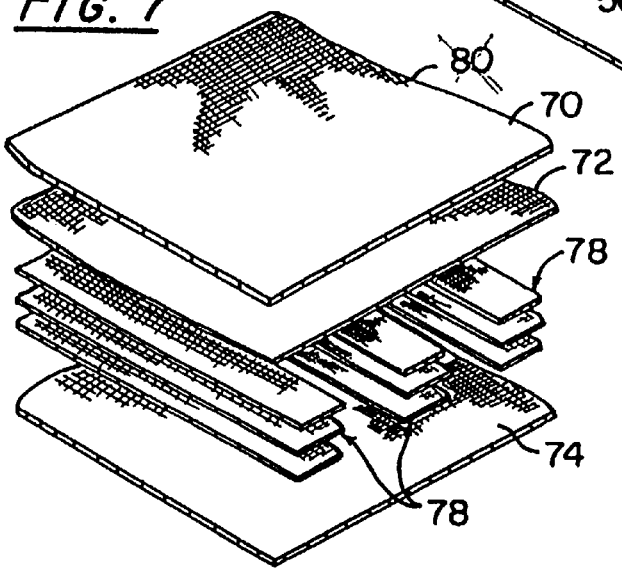
FIG. 7 is an exploded fragmentary prospective view, drawn substantially on the same scale of FIGS. 3 and 5, further illustrating the spacer structure shown in FIG. 6.
Figure 6:
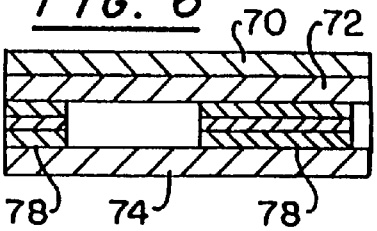
FIG. 6 is a sectional view, drawn on substantially the same scale as FIGS. 2 and 4, illustrating another modification in the spacer means between the inner layer and the intermediate layer and a pad constructed in accordance with one embodiment of the present invention.

FIGS. 4 and 5 show a portion of a pad for a protective garment constructed in accordance with another embodiment of the present invention. FIG. 4 may be considered as taken a substantially along line 2—2 on FIG. 1. The pad has cover layer 50, optional intermediate layer 52 and base layer 54. Between the base layer 54 and the intermediate layer 52 is a plurality of spaced dash apart spacer elements 56. The spacer elements 56 provide fluid channels between the base layer 54 and the optional intermediate layer 52 and thus provide the thermal insulation while facilitating fluid dispersal. Each of the spacer elements 56 is generally U-Shaped with legs 56*a* stitched to the inner layer 54 and a body portion 56*b* stitched to the intermediate layer 52. However, the legs 56*a* may be attached to the intermediate layer 52 and the body portion 56*b* may be attached to the inner layer 54. The spacer elements 56 comprise strips of flexible heat resistant or heat insulation material. The cover layer 50 (with or without intermediate layer 52) may be stitched on otherwise attached so as to follow the contour formed by spacer elements 56. A pad of this type may be used atop or within the layers of a protective garment. If the outer shell of the garment is sufficiently impervious to hot fluids, the base layer 54 may be eliminated. FIGS. 6 and 7 show a portion of a pad for a protective garment with accordance with yet another embodiment of the present invention. FIG. 6 may be considered as being taken substantially line 2—2 FIG. 1. The pad comprises an cover layer 70, optional intermediate layer 72 and an inner layer 74. Between the inner layer 74 and the optional intermediate layer 72 is a plurality of spaced-apart stacks 78 of strips of flexible heat resistant material. The spaces between the stacks 78 provide fluid that channels between inner layer 74 and the intermediate layer 72, thus providing both thermal insulation and facilitating the conduction of fluids. The cover layer 70 (with or without intermediate layer 72) may be stitched or otherwise attached so as to follow the contour formed by spacer elements 78. A pad of this type may be placed with the layers of a protective garment or atop the layers of a protective garment (not shown). If the outer shell of the garment is sufficiently impervious to hot fluids, the base layer 74 may be eliminated.

Figure 8:
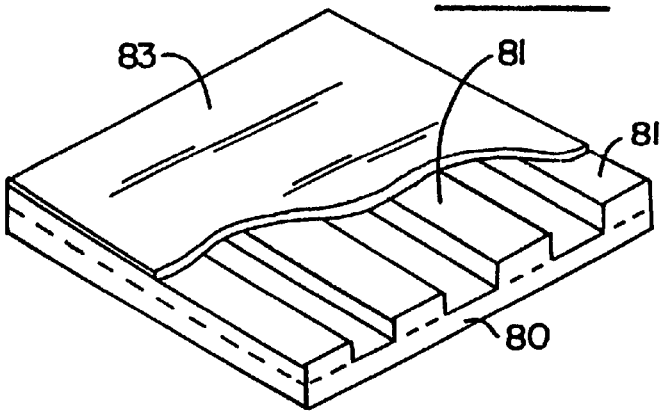
FIG. 8 is a sectional view drawn on a smaller scale than FIG. 2, illustrating another embodiment of the present invention.

FIG. 8 shows a portion of a pad for a protective garment in accordance with yet another embodiment of the present invention. FIG. 8 may also be considered as a view from the same perspective as in FIGS. 3, 5 and 7. The pad comprises base member 80 which is disposed on or otherwise outside outer shell of the protective garment, and having disposed thereupon spacer members 81 as indicated by the portions separated from the base member 80 by dotted lines. Base member 80 and spacer member 81 may either be as an integral unit or constructed from separate piece parts. Elements 80 and 81 may be constructed of any suitable insulative and preferably flexible material (such as Teflon or other suitable equipment materials) which will allow the area of the protective garment covered by such a pad to be comfortable for movement within such a garment. It is also preferred that such materials be completely or substantially impervious to hot fluids. Such a construction causes such hot fluids to be channeled from the pad area by taking a path of least resistance through the channels to the outside of the garment. This is particularly important when the pad is pressed placed against a surface which is a source of hot fluids, where the channels found in the pad provide a venue of escape for the hot fluids rather than forcing them toward the inside of the garment (i.e., within the outer shell on layer 50). As an alternative embodiment, spacer elements 81 may be formed by a stack of heat resistant material, such as item 78 shown in FIG. 7. In such cases it is preferred that an additional flame resistant and/or abrasion resistant member 83 be attached over the base member and spacer members 80 and 81, respectively, so as to protect the pad construction. A more preferred embodiment of such construction is to have the flame resistant and/or abrasive resistant members attached so as to follow the contour of the channeling formed by the spacer elements 81.

As yet another alternative embodiment, a pad may be constructed by eliminating base member 80 altogether and placing the spacer members 81 directly on the outer shell on the garment. This may be done by any suitable means such as through the use of adhesives, stitching, or hot welding. Again, where the spacer elements are provided by a stack of material as shown in item 78, is preferred that cover layer 83 be used to protect the pad construct. The cover layer 83 may be stitched or otherwise attache so as to follow the contour formed by spacer elements 81 (or by those like elements 78).

It is preferred that where cover 50, 70 and 83 do not follow the contour of the respective channels (such as where they are laid flat), the cover piece be made of a fluid-porous material which will allow a fluid to enter the channels and disperse within the channels so as not to defeat the pad's purpose. Where cover piece 83 follows the contour of the channels, the channels thus remain open to the outside of the garment, ready to accept and disperse fluids. In this case, the cover layers may be impervious to fluids.

As yet another embodiment, the pad may be formed simply by using a plurality of strips, such as 81, directly on the outer shell of the garment. Materials which are suited for the construction of both base member 80 and spacer members 81 and included a wide variety of heat and flame resistant polymers and the like, such as Teflon and heat resistant plastics or rubbers. It is preferred that such materials have a suitable degree of abrasion resistance to withstand the normal wear and tear occasioned by use in hostile environments, such as firefighting environments.

All of the spacer means and elements shown and disclosed herein are capable of containing thermal insulation qualities and characteristics and a pad for a protective garment even when localized pressure or loads are applied to portions of the pad, and also as localized pressure in the pad occurs as the firefighter moves and works.

A protective garment constructed in accordance with the present invention may be a coat and/or trousers or other garment which includes at least one pad described in accordance with the present invention.

In view of the above discussion of the drawings herein, it is understood that a pad for a protective garment constructed in accordance with the present invention has the same or better qualities of protection against the environment than conventional firefighter garments, such as conventional firefighting garments. In addition to these protective qualities, a pad in accordance with this invention facilitates the conduction and dispersal of dangerous fluids, such as steam and hot water. Accordingly, a firefighter wearing a garment provided with pad in accordance with the present invention is able to work in a more effective manner by being able to move more quickly and effectively and to bear contact with heated surfaces, particularly those from which dangerous heated fluids emanate.

Although the preferred embodiment of the pad for a protective garment in accordance with this invention has been described, it will be understood that within the scope of this invention various changes may be made in the form, details, portion and arrangement of parts, the combination of parts and the manner of use which generally stated consists in a pad for a protective garment within the scope of the present invention as defined by the appended claims. The substitution of the equivalent materials, the use of various geometric arrangements, or the integration or separation of parts, may be made without departing from the spirit of the invention.

What is claimed:

1. A protective garment, comprising:

at least one layer of material defining the protective garment and providing the garment with abrasive resistant and thermal insulative properties, said protective garment having an inside and an outside where the outside is exposed to the external environment, which may include one or more sources of steam, hot water, or other hot fluids; and a pad comprising spacer means affixed to the outside of the protective garment so as to cover an expansive area which is substantially impervious to hot fluids, said spacer means being arranged to form a plurality of fluid pathways in said pad for dispersing or conducting hot fluids, if received by the pad when the pad is pressed against a source thereof, so that the dispersed or conducted fluids are not forced through the expansive area covered by the pad.

2. A protective garment according to claim 1 wherein said spacer means comprises a material selected from the group consisting of heat-resistant materials and flame-resistant materials.

3. A protective garment according to claim 1 wherein said pad additionally comprises a cover member disposed over said spacer means.

4. A protective garment according to claim 3 wherein said spacer means forms a contoured surface and wherein said cover member is disposed over said surface so as to follow said contour of said spacer means.

5. A protective garment according to claim 4 wherein said cover member comprises an abrasion-resistant material.

6. A protective garment, comprising:

an inner layer of a thermal insulative material and an outer layer of an abrasion resistant material, where said abrasion resistant material is located on the outside of the garment and is exposed to the external environment, which may include one or more sources of steam, hot water, or other hot fluids; and a pad comprising a base member secured to said outer layer, the base member being substantially impervious to hot fluids, and spacer means disposed on said base member to form a plurality of channel means defining fluid pathways in said pad for dispersing or conducting hot fluids, if received by the pad when the pad is pressed against a source thereof, so that the dispersed or conducted fluids are not forced through the expansive area covered by the pad.

7. A protective garment according to claim 6 wherein said spacer means comprises a material selected from the group consisting of heat-resistant materials and flame-resistant materials.

8. A protective garment according to claim 6 wherein said pad additionally comprises a cover member disposed over said spacer means.

9. A protective garment accordingly to claim 8 wherein said spacer means forms a contoured surface and wherein said cover member is disposed over said surface so as to follow said contour of said spacer means.

10. A protective garment according to claim 8 wherein said cover member comprises an abrasion-resistant material.

11. A protective garment, comprising:

at least one layer of material defining the protective garment and providing the garment with abrasive resistant and thermal insulative properties, said protective garment having an inside and an outside where the outside is exposed to the external environment, which may include one or more sources of steam, hot water, or other hot fluids; and a pad comprising a mesh material affixed to the outside of the protective garment, so as to cover an expansive area which is substantially impervious to hot fluids, said mesh material defining a plurality of channel means defining fluid pathways in said pad for dispersing or conducting hot fluids, if received by the pad when the pad is pressed against a source thereof, so that the dispersed or conducted fluids are not forced through the expansive area covered by the pad.

12. A protective garment according to claim 11 wherein said mesh material comprises a material selected from the group consisting of heat-resistant materials and flame-resistant materials.

13. A protective garment according to claim 11 wherein said pad additionally comprises a cover member disposed over said plurality of channel means.

14. A protective garment according to claim 13 wherein said plurality of channel means form a contoured surface and wherein said cover member is disposed over said surface so as to follow said contour of said channel means.

15. A protective garment according to claim 13 wherein said cover member comprises an abrasion resistant material.

16. A protective garment according to claim 11 wherein said channel means defines channels extending substantially parallel to said at least one layer.

* * * * *